US007597761B2

(12) United States Patent
Van Denend

(10) Patent No.: US 7,597,761 B2
(45) Date of Patent: Oct. 6, 2009

(54) SEALING ASSEMBLY FOR AN INK CHAMBER WHICH INCLUDES SELF-LUBRICATING ANILOX ROLL SEAL WITH IMPROVED BLADE/SEAL AREA

(76) Inventor: Mark E. Van Denend, 349 E. 36th St., Paterson, NJ (US) 07504

( * ) Notice: Subject to any disclaimer, the term of this patent is extended or adjusted under 35 U.S.C. 154(b) by 440 days.

(21) Appl. No.: 11/502,647

(22) Filed: Aug. 10, 2006

(65) Prior Publication Data

US 2008/0034997 A1 Feb. 14, 2008

(51) Int. Cl.
*B05C 3/00* (2006.01)

(52) U.S. Cl. ..... 118/410; 118/413; 101/350.6; 184/101

(58) Field of Classification Search ..... 118/410, 118/413; 184/101; 101/350.6; 277/411
See application file for complete search history.

(56) References Cited

U.S. PATENT DOCUMENTS

| | | | | |
|---|---|---|---|---|
| 3,273,536 | A * | 9/1966 | Galer et al. | 118/413 |
| 5,027,513 | A | 7/1991 | Allison, Jr. | |
| 5,150,651 | A | 9/1992 | Flores | |
| 5,410,961 | A | 5/1995 | DeNicola et al. | |
| 5,483,885 | A | 1/1996 | Leineweber | |
| 5,662,042 | A | 9/1997 | Compton et al. | |
| 6,016,748 | A | 1/2000 | Kolbe | |
| 6,412,410 | B1 | 7/2002 | Poullier | |
| 6,571,703 | B1 | 6/2003 | Metrope | |
| 6,598,525 | B2 | 7/2003 | Metrope | |
| 6,629,496 | B1 | 10/2003 | Boose et al. | |
| 6,672,207 | B2 | 1/2004 | Kolbe et al. | |
| 6,739,248 | B2 | 5/2004 | Kolbe et al. | |
| 2003/0121435 | A1 | 7/2003 | Jendroska et al. | |
| 2004/0261640 | A1 | 12/2004 | Maccagni et al. | |

FOREIGN PATENT DOCUMENTS

| | | |
|---|---|---|
| GB | 847173 | 12/1958 |

* cited by examiner

*Primary Examiner*—Laura Edwards
(74) *Attorney, Agent, or Firm*—Richard M. Goldberg

(57) ABSTRACT

A sealing assembly for an ink chamber associated with an anilox roll, includes a doctor blade having a doctoring edge, with each end having a notch at the doctoring edge, and first and second seals adapted to seal ends of the ink chamber. Each seal includes a peripheral supporting wall, an upper wall thereon including an upper concave surface for engaging an outer surface of the anilox roll, a flat upper supporting surface at opposite ends of the upper wall on which ends of the doctor blade seat, and an extension above the flat upper supporting surface for engaging within the notch at the end of the doctor blade to permit the doctor blade to bend thereat. A lubricant chamber is defined therein and the upper wall includes an opening through which the lubricant is forced out of the lubricant chamber due to external pressure.

6 Claims, 11 Drawing Sheets

SEALING ASSEMBLY FOR AN INK CHAMBER WHICH INCLUDES SELF-LUBRICATING ANILOX ROLL SEAL WITH IMPROVED BLADE/SEAL AREA

BACKGROUND OF THE INVENTION

The present invention relates to a sealing assembly including self-lubricating doctor and sealing blade seals for an ink chamber associated with an anilox roll and doctor and sealing blades for use therewith, and which permits the doctor and sealing blades to bend at their ends to provide an improved blade/seal area.

Conventionally, in printing machines, such as flexographic printing machines, an ink transfer or anilox roll transfers ink to an adjacent plate roll for printing. Ink is supplied to the anilox roll from an ink chamber defined by a chamber housing which partially surrounds the anilox roll. Specifically, ink is supplied through an ink supply tube and then through an ink supply line in the chamber housing, into the ink chamber. In like manner, ink is removed from the ink chamber through an ink return line in the chamber housing and then through an ink return tube.

In order to prevent the escape of ink from the chamber, while ensuring that the ink enters the cells in the anilox roll and has a predetermined volume on the anilox roll, doctor and sealing blades are provided at the entry and exit positions of the anilox roll relative to the ink chamber. The blades are fixed to the chamber housing so that the blades overhang the chamber housing and contact the anilox roll.

With this arrangement, the outer surface of the anilox roll passes through the ink chamber and picks up ink for printing. The ink is metered by means of the doctor blade held to the outlet end of the chamber housing, and sealed with a sealing blade held to the inlet end, with the free ends of the blades being in contact with the outer surface of the anilox roll.

A seal is provided at each end of the blade, that is, at each end of an anilox roll for sealing the ends thereof. Examples of such arrangements are shown in U.S. Pat. Nos. 6,739,248; 6,672,207; and 5,150,651.

Each seal is formed by a compressible body. Since the seals provided at each end of the anilox roll function to seal the ends of the ink chamber, each seal must lie against the peripheral surface of the rotating anilox roller. As a result, each seal is therefore exposed to mechanical stresses as well as wear. Further, during the printing operation, the blades, which press against the anilox roll, also wear. The geometry of the sealing function between the anilox roll, the two blades and the end seal changes.

Conventionally, each end of a blade sits upon a flat supporting area of the respective seal. As a result, there is not much flexibility at the opposite ends of the blades where they are held by the chamber seals. Because there is more force by the seals on each blade, that is, at the ends of the blades where they are held, the ends of the blades are less capable of flexing or bending at these points. As a result, there is uneven wear on the ends of the blades adjacent the seals, which tends to cause more wear and more leakage of ink at the ends of the anilox roll. Further, ink tends to ride under the blade, that is, between the blade and the flat supporting area of the seal, causing the blade to lift up away from the seal, thereby resulting in still more leakage. Thus, the place where the seal, anilox roll and blades join, is particularly susceptible to leakage.

If a seal is lubricated, the blades will not wear as much in the seal areas as compared to an area outside of the seal. However, if a seal is not lubricated, the dried ink will wear the blades faster in the seal areas. In either case, the areas where the anilox roll, blades and seals join are susceptible to leakage because of geometric changes.

SUMMARY OF THE INVENTION

Accordingly, it is an object of the present invention to provide a sealing assembly including doctor and sealing blade seals for an ink chamber associated with an anilox roll and doctor and sealing blades for use therewith, that overcomes the aforementioned problems.

It is another object of the present invention to provide a sealing assembly including doctor and sealing blade seals for an ink chamber associated with an anilox roll and doctor and sealing blades for use therewith, which permits the doctor and sealing blades to bend at the positions of the seals while still providing a good seal thereat in order to provide more even wear along the length of the blade.

It is still another object of the present invention to provide a sealing assembly including doctor and sealing blade seals for an ink chamber associated with an anilox roll and doctor and sealing blades for use therewith, in which the seals having extensions that receive notches in the blades to permit such bending such that an end edge of the blade at the notch slides along the inner facing side wall surface of the seal to maintain a sealing arrangement between the blade and the seal when the blade bends at the notch.

It is yet another object of the present invention to provide a sealing assembly including doctor and sealing blade seals for an ink chamber associated with an anilox roll and doctor and sealing blades for use therewith, which provides a quantity of lubricant that varies in dependence upon pressure applied to the seals, thereby providing a self-lubricating seal that lubricates itself as the blades wear.

It is a further object of the present invention to provide a sealing assembly including doctor and sealing blade seals for an ink chamber associated with an anilox roll and doctor and sealing blades for use therewith, in which the lubricant is provided in internal cavities of the seals and which is caused to flow to the anilox roll/seal interface upon increased pressure of the seals on the anilox roll.

It is a still further object of the present invention to provide a sealing assembly including doctor and sealing blade seals for an ink chamber associated with an anilox roll and doctor and sealing blades for use therewith, that is easy to use and inexpensive to manufacture.

In accordance with an aspect of the present invention, a sealing assembly for a fluid chamber which supplies fluid to a roll, includes a first seal adapted to seal an end of the fluid chamber and a second seal adapted to seal an opposite end of the fluid chamber. The first seal includes a first upper wall including a first upper concave surface adapted to engage an outer surface of the roll, and a first inner facing side wall surface. The second seal includes a second upper wall including a second upper concave surface adapted to engage the outer surface of the roll, and a second inner facing side wall surface. The sealing assembly includes a doctor blade having a doctoring edge for doctoring fluid on the roll, and opposite first and second end edges. The first end edge is in sealing engagement with the first inner facing side wall surface and the second end edge is in sealing engagement with the second inner facing side wall surface.

The doctor blade includes first and second opposite ends. The first seal preferably further includes a first flat upper doctor blade supporting surface at one end of the first upper wall for receiving the first end of the doctor blade thereon, and a first doctor blade engaging extension positioned above the first flat upper supporting surface. The second seal preferably further includes a second flat upper doctor blade supporting surface at one end of the second upper wall for receiving the second end of the doctor blade thereon, and a second doctor blade engaging extension positioned above the second flat upper supporting surface. In such case, the first end of the doctor blade has a first cut-out notch therein at the doctoring edge for engaging with the first doctor blade engaging extension to accurately align the first end of the doctor blade with the first seal, the first cut-out notch having a first side edge forming the first end edge in sealing engagement with the first inner facing side wall surface. In like manner, the second end of the doctor blade has a second cut-out notch therein at the doctoring edge for engaging with the second doctor blade engaging extension to accurately align the second end with the second seal, the second cut-out notch having a second side edge forming the second end edge in sealing engagement with the second inner facing side wall surface.

Preferably, each doctor blade engaging extension is formed as a continuation of a respective the upper wall. Also, preferably each of the first and second upper concave surfaces is formed by first and second spaced apart upper concave surface portions.

In addition, the first seal includes a third doctor blade engaging extension positioned above the first flat upper doctor blade supporting surface in spaced relation from the first doctor blade engaging extension, and the second seal includes a fourth doctor blade engaging extension positioned above the second flat upper doctor blade supporting surface in spaced relation from the second doctor blade engaging extension. In such case, the first end of the doctor blade includes two first cut-out notches therein at the doctoring edge for engagement with the first and third extensions, and a tab between the two first cut-out notches for engagement with the first flat upper doctor blade supporting surface; and the second end of the doctor blade includes two second cut-out notches therein at the doctoring edge for engagement with the second and fourth extensions, and a tab between the two second cut-out notches for engagement with the second flat upper doctor blade supporting surface.

There is preferably a sealing blade having a sealing edge for sealing fluid on an opposite side of the fluid chamber, and opposite first and second end edges. The first end edge of the sealing blade is in sealing engagement with the first inner facing side wall surface and the second end edge of the sealing blade is in sealing engagement with the second inner facing side wall surface. The sealing blade includes opposite first and second ends. The first seal preferably further includes a first flat upper sealing blade supporting surface at an opposite end of the first upper wall for receiving the first end of the sealing blade thereon, and a first sealing blade engaging extension positioned above the first flat upper sealing blade supporting surface. The second seal preferably further includes a second flat upper sealing blade supporting surface at an opposite end of the second upper wall for receiving the second end of the sealing blade thereon, and a second sealing blade engaging extension positioned above the second flat upper sealing blade supporting surface. In such case, the first end of the sealing blade has a first cut-out notch therein for engaging with the first sealing blade engaging extension to accurately align the first end of the sealing blade with the first seal, the first cut-out notch of the sealing blade having a first side edge forming the first end edge of the sealing blade in sealing engagement with the first inner facing side wall surface. In like manner, the second end of the sealing blade preferably further has a second cut-out notch therein for engaging with the second sealing blade engaging extension to accurately align the second end of the sealing blade with the second seal, the second cut-out notch of the sealing blade having a second side edge forming the second end edge of the sealing blade in sealing engagement with the second inner facing side wall surface.

Also, the first seal includes a third sealing blade engaging extension positioned above the first flat upper sealing blade supporting surface in spaced relation from the first sealing blade engaging extension; and the second seal includes a fourth sealing blade engaging extension positioned above the second flat upper sealing blade supporting surface in spaced relation from the second sealing blade engaging extension. The first end of the sealing blade includes two first cut-out notches therein at the sealing edge for engagement with the first and third sealing blade engaging extensions, and a tab between the two first cut-out notches for engagement with the first flat upper sealing blade supporting surface; and the second end of the sealing blade includes two second cut-out notches therein at the sealing edge for engagement with the second and fourth sealing blade engaging extensions, and a tab between the two second cut-out notches for engagement with the second flat upper sealing blade supporting surface.

In accordance with another aspect of the present invention, a method of sealing a fluid chamber which supplies fluid to a roll, includes the steps of positioning a first seal of a type having a first upper wall including a first upper concave surface adapted to engage an outer surface of the roll, and a first inner facing side wall surface, at an end of the fluid chamber to seal the end of the fluid chamber, and positioning a second seal of a type having a second upper wall including a second upper concave surface adapted to engage the outer surface of the roll, and a second inner facing side wall surface, at an opposite end of the fluid chamber to seal the opposite end of the fluid chamber. Then, a doctor blade having a doctoring edge for doctoring fluid on the roll is positioned against the roll such that a first end edge thereof is in sealing engagement with the first inner facing side wall surface and an opposite second end edge thereof is in sealing engagement with the second inner facing side wall surface.

The doctor blade includes first and second opposite ends; the first seal includes a first flat upper doctor blade supporting surface at one end of the first upper wall for receiving the first end of the doctor blade thereon, and a first doctor blade engaging extension positioned above the first flat upper doctor blade supporting surface; the second seal includes a second flat upper doctor blade supporting surface at one end of the second upper wall for receiving the second end of the doctor blade thereon, a second doctor blade engaging extension positioned above the second flat upper doctor blade supporting surface; the first end of the doctor blade has a first cut-out notch therein at the doctoring edge; and the second end of the doctor blade has a second cut-out notch therein at the doctoring edge. The method further includes the steps of engaging the first cut-out notch with the first doctor blade engaging extension to accurately align the first end of the doctor blade with the first seal such that a first side edge of the first cut-out notch which forms the first end edge is in sealing engagement with the first inner facing side wall surface. The method also includes the step of engaging the second cut-out notch with the second doctor blade engaging extension to accurately align the second end of the doctor blade with the second seal such that a second side edge of the second cut-out notch which forms the second end edge is in sealing engagement with the second inner facing side wall surface.

There is the further step of positioning a sealing blade having a sealing edge for sealing fluid on an opposite side of the fluid chamber against the roll such that a first end edge thereof is in sealing engagement with the first inner facing side wall surface and an opposite second end edge thereof is in sealing engagement with the second inner facing side wall surface.

In such case, the sealing blade includes opposite first and second ends; the first seal includes a third flat upper sealing blade supporting surface at an opposite end of the first upper wall for receiving the first end of the sealing blade thereon, and a third sealing blade engaging extension positioned above the third flat upper sealing blade supporting surface; the second seal includes a fourth flat upper sealing blade supporting surface at an opposite end of the second upper wall for receiving the second end of the sealing blade thereon, and a fourth sealing blade engaging extension positioned above the fourth flat upper sealing blade supporting surface; the first end of the sealing blade has a first cut-out notch therein at the sealing edge; and the second end of the sealing blade has a second cut-out notch therein at the sealing edge. In such case, the method further includes the step of engaging the first cut-out notch with the third sealing blade engaging extension to accurately align the first end of the sealing blade with the first seal such that a first side edge of the first cut-out notch of the sealing blade is in sealing engagement with the first inner facing side wall surface. The method also includes the step of engaging the second cut-out notch with the fourth sealing blade engaging extension to accurately align the second end of the sealing blade with the second seal such that a second side edge of the second cut-out notch of the sealing blade is in sealing engagement with the second inner facing side wall surface.

In accordance with still another aspect of the present invention, a seal adapted to seal an end of a fluid chamber which supplies fluid to a roll, includes at least one supporting wall, an upper wall including an upper concave surface on the at least one supporting wall and adapted to engage an outer surface of the roll, a flat upper doctor blade supporting surface at one end of the upper wall for receiving an end of a doctor blade thereon, an inner facing side wall surface, and a doctor blade engaging extension positioned above the flat upper doctor blade supporting surface and adapted to engage within a notch at an end of the doctor blade to permit the doctor blade to bend thereat such that an end edge of the doctor blade at the notch slides along the inner facing side wall surface to maintain a sealing arrangement between the doctor blade and the seal when the doctor blade bends at the notch.

In accordance with yet another aspect of the present invention, a seal adapted to seal an end of a fluid chamber which supplies fluid to a roll, includes at least one supporting wall, an upper wall on the at least one supporting wall, the upper wall including an upper concave surface adapted to engage an outer surface of the roll, opposite end walls, a lubricant chamber defined between the at least one supporting wall, the upper wall and the ends walls, for holding a lubricant therein, the seal being made of a deformable and resilient material, and wherein the upper wall includes at least one opening through which the lubricant is forced out of the lubricant chamber when the seal is deformed as a result of external pressure thereon.

Each end wall includes a flat upper blade supporting surface for receiving an end of a blade thereon.

The upper concave surface includes first and second spaced apart upper concave surface portions with an intermediate upper wall portion therebetween, and the at least one opening is formed through the intermediate upper wall portion.

In accordance with a further aspect of the present invention, a doctor/sealing blade is provided for use with seals adapted to doctor/seal ends of a fluid chamber which supplies fluid to a roll, with the seals being of a type including at least one supporting wall having an inner facing side wall surface, an upper wall including an upper concave surface on the at least one supporting wall and adapted to engage an outer surface of the roll, a flat upper blade supporting surface at one end of the upper wall, and a blade engaging extension positioned above each the flat upper blade supporting surface. The doctor/sealing blade includes a thin plate having a lengthwise edge and opposite first and second ends, each end adapted to seat on the flat upper blade supporting surface of each respective seal, and at least one cut-out notch at each end of the thin plate at the lengthwise edge and adapted to receive a blade engaging extension of one seal therein to permit the blade to bend thereat such that a side edge of the at least one cut-out notch is in sealing engagement with the inner facing side wall surface.

Preferably, each end of the blade includes two spaced apart cut-out notches therein at the lengthwise edge and a tab between the cut-out notches.

The above and other objects, features and advantages of the invention will become readily apparent from the following detailed description thereof which is to be read in connection with the accompanying drawings.

DETAILED DESCRIPTION

Figure 11:
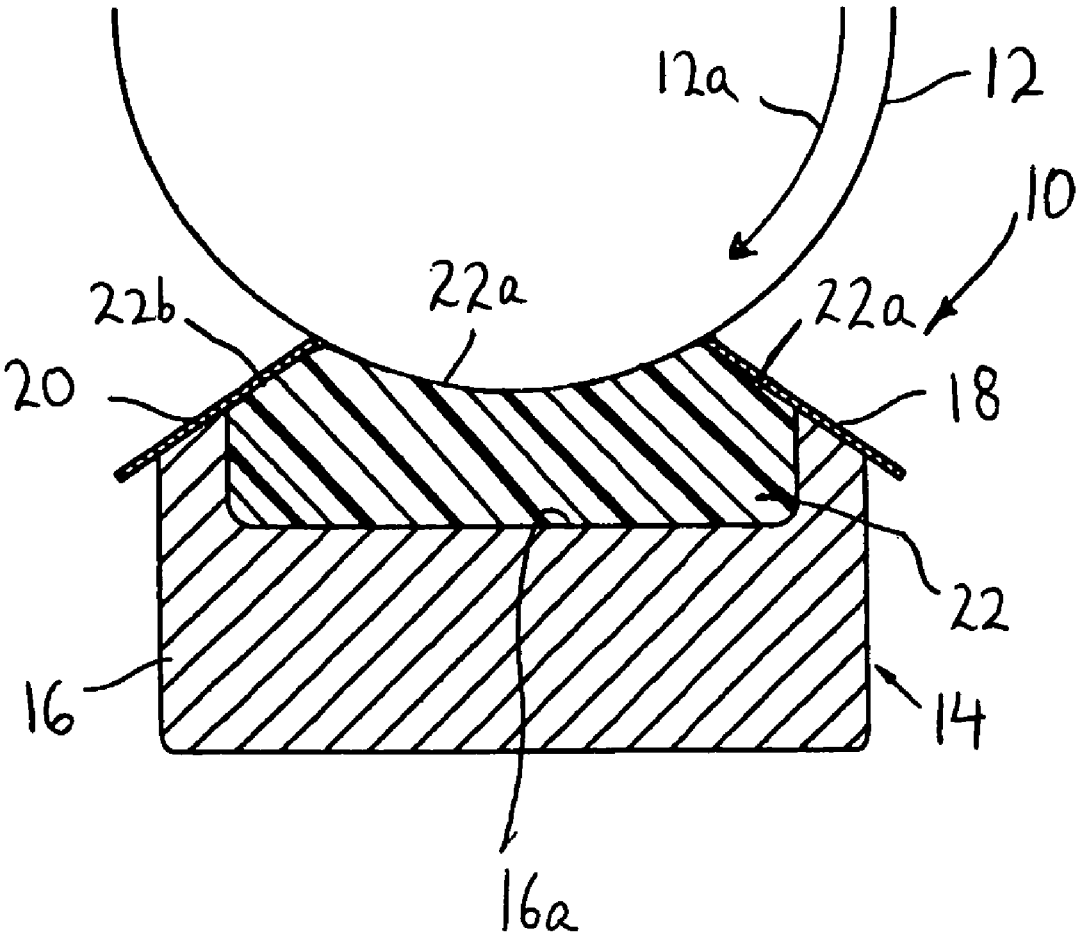
FIG. 11 PRIOR ART
FIG. 11 is a cross-sectional-view of a conventional doctor and sealing blade seal in association with an anilox roll.

Referring to the drawings in detail, and initially to FIG. 11 thereof, there is shown a conventional doctor and sealing blade sealing assembly 10. Conventionally, in printing machines, such as flexographic printing machines, an ink transfer or anilox roll 12 transfers ink to an adjacent plate roll (not shown) for printing. Ink is supplied to anilox roll 12 from an ink chamber 14 defined by a chamber housing 16 which is adjacent to and may partially surround anilox roll 12. Anilox roll 12 rotates in the direction of arrow 12*a*.

In order to prevent the escape of ink from ink chamber 14, while ensuring that the ink enters the cells in anilox roll 12 and has a predetermined volume on anilox roll 12, sealing and doctor blades 18 and 20 are provided at the entry and exit positions of anilox roll 12 relative to ink chamber 14. Blades 18 and 20 are fixed to chamber housing 16 by an blade holder (not shown) so that blades 18 and 20 overhang chamber housing 16 and contact anilox roll 12. Blades 18 and 20 are placed at an angle against the periphery of anilox roll 12 and help to define ink chamber 14 which extends along the length of anilox roll 12.

Seals 22 are provided at each end of anilox roll 12 to seal the ends of ink chamber 14. Each seal 22 has an upper concave surface 22*a* which lies against the peripheral surface of the rotating anilox roll 12. The edges of upper concave surface 22*a* continue in downwardly sloping flat supporting surfaces 22*b* and 22*c* which support blades 18 and 20, respectively.

With this arrangement, the outer surface of anilox roll 12 passes through ink chamber 14 and picks up ink for printing. The ink is metered by means of doctor blade 20 held to the outlet end of chamber housing 16, and sealed with sealing blade 18 held to the inlet end, with the free ends of blades 18 and 20 being in contact with the outer surface of anilox roll 12.

However, because each end of blades 18 and 20 sits upon a flat supporting surface 22*a* or 22*b* of a respective seal 22, there is not much "give" or flexibility at the ends of each blade 18 and 20 where it is held by seals 22. For example, when a blade 18 or 20 is pressed down by air and other forces at its center, the blade cannot bend a great amount and there is much pressure on the blade. Because there is more force by seals 22 on each blade 18 and 20 at the ends thereof where they are held, they are less capable of flexing or bending at these points. As a result, there is uneven wear of blades 18 and 20 adjacent seals 22, which tends to cause more wear and more leakage of ink at the ends of anilox roll 12. Further, ink scraped by blades 18 and 20 tends to ride under the blades, that is, between blades 18 and 20 and flat supporting surfaces 22*a* and 22*b* of seals 22, causing blades 18 and 20 to lift up away from seals 22, thereby resulting in still more leakage.

If a seal 22 is lubricated, blades 18 and 20 will not wear as much in the seal areas as compared to an area outside of seal 22. On the other hand, if a seal 22 is not lubricated, the dried ink will wear blades 18 and 20 faster at flat supporting surfaces 22*a* and 22*b*. In either case, the areas where anilox roll 12, blades 18 and 20 and seals 22 join are susceptible to leakage because of geometric changes.

In accordance with a first aspect of the present invention, as shown in FIGS. 1-10, a blade/ink chamber seal 122 for use in a sealing assembly according to the present invention for use with an anilox roll 112 and sealing blade 118 and doctor blade 120, includes spaced apart side walls 122*d* and 122*e* connected together at upper ends thereof by an upper wall 122*f* having an upper surface 122*a* which continues in inlet and outlet downwardly sloping flat upper blade supporting surfaces 122*b* and 122*c* that support blades 118 and 120, respectively. The opposite ends of downwardly sloping flat upper blade supporting surfaces 122*b* and 122*c* are connected to spaced apart end walls 122*g* and 122*g*, and side edges thereof are connected to side walls 122*d* and 122*e*. As a result, a lubricant chamber 113 is defined between side walls 122*d* and 122*e*, upper wall 122*f* and end walls 122*g* and 122*g*. There is no bottom wall because the lower ends of side walls 122*d* and 122*e* and end walls 122*g* and 122*g*, form a seal along a wall 16*a* (FIG. 11) of chamber housing 16, which effectively functions as the bottom wall thereof.

In accordance with the present invention, upper surface 122*a* is formed by two spaced apart upper concave surface portions 122*a*1 and 122*a*2, with an intermediate upper wall portion 122*a*3 therebetween. Each upper concave surface portion includes blade engaging extensions 122*i* and 122*j* at opposite ends thereof which extend directly above downwardly sloping flat upper blade supporting surfaces 122*b* and 122*c* and which follow and continue the same curvature as upper concave surface portions 122*a*1 and 122*a*2. However, it will be appreciated that blade engaging extensions 122*i* and 122*j* need not follow and continue the same curvature as upper concave surface portions 122*a*1 and 122*a*2. Thus, there are two such blade engaging extensions 122*i* on one side of seal 122 which are positioned in spaced apart relation above downwardly sloping flat upper blade supporting surface 122*b* and there are two such blade engaging extensions 122*j* on the opposite side of seal 122 which are positioned in spaced apart relation above downwardly sloping flat upper supporting surface 122*c*.

Figure 10:
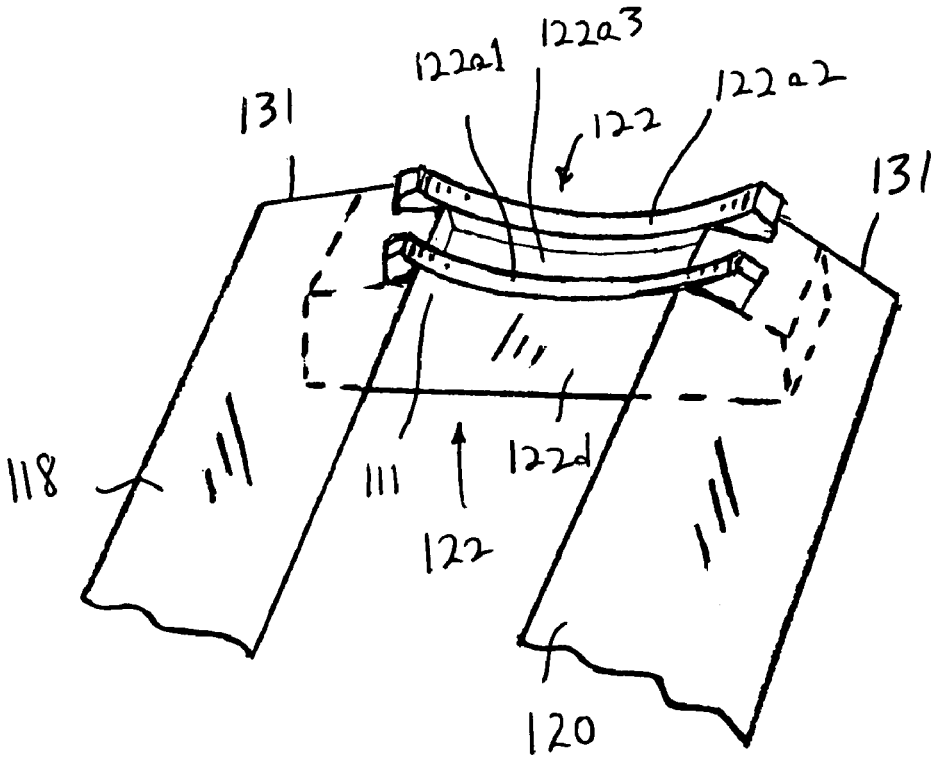
FIG. 10 is a perspective view of the seal assembly with the doctor blade and sealing blade assembled with the doctor and sealing blade seal.
Figure 9:
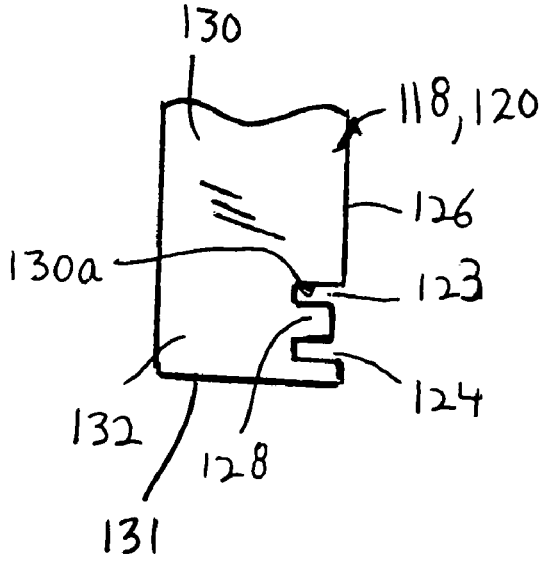
FIG. 9 is a plan view of the end portion of a doctor/sealing blade according to the present invention.

In correspondence therewith, each blade 118 and 120, as shown best in FIGS. 9 and 10, is provided with two spaced apart notches 123 and 124 at each end and along the same lengthwise doctoring/sealing edge 126, thereby defining a flat generally rectangular cantilevered tab 128 therebetween. When blades 118 and 120 are assembled in the sealing assembly, the two spaced apart notches 123 and 124 receive two adjacent blade engaging extensions 122*i* or 122*j* on one side of each seal 122. Tab 128 thereby rests on and seals against the respective downwardly sloping flat upper blade supporting surface 122*b* or 122*c*. As a result, the main central portion 130 of each blade 118 and 120 which extends between notches 123 at opposite ends thereof, is permitted to bend relative to seal 122. Thus, even though the end portion 132 of each blade 118 and 120, that is, the portion other than main central portion 130 which contains notches 123 and 124 and tab 128, is held flush with downwardly sloping flat upper blade supporting surface 122*b* or 122*c*, main central portion 130 can flex or bend relative thereto. During such bending, the side edge 130*a* of main body 130 defined by cut-out notch 123 bends or folds down and scrapes along the inner facing side wall surface 111 of side wall 122*d* so as to provide an effective sealing arrangement thereat. In addition, notches 123 and 124, along with blade engaging extensions 122*i* or 122*j*, serve to properly align blades 118 and 120 on each seal 122.

This means that blades 118 and 120 can bend just as easily at their ends in the same manner as they can bend at their center portions so that any wear along doctoring/sealing edge 126 will wear evenly. In addition, any caked ink that travels between downwardly sloping flat upper blade supporting surfaces 122*b* and 122*c* and blades 118 and 120 will not affect the sealing relation since the side edges 130*a* of blades 118 and 120 will still provide an effective sealing arrangement against inner facing side wall surface 111 of side wall 122*d* of seal 122.

Thus, notches 123 and 124 permit blades 118 and 120 to bend properly, as well as positioning blades 118 and 120 properly on top of seal 122, while still permitting blades 118 and 120 to seal at inner facing side wall surface 111 of side wall 122*d* of seal 122. As a result of this construction, blades 118 and 120 are permitted to bend at the position of seal 122 while still providing a good sealing capability thereat.

It will be appreciated that the present invention is not limited to the above embodiment, but rather, is limited only by the claims herein. For example, upper concave surface portion 122*a*2 and intermediate upper wall portion 122*a*3, along with notch 124, can be eliminated so that there would be only upper concave surface portion 122*a*1 and single notch 123 at each end of each blade 118 and 120.

As a further embodiment, notches 123 and 124, and blade engaging extensions 122*i* and 112*j*, can be eliminated entirely. In other words, it is only important that an edge of the blade 118 and 120 seal against inner facing side wall surface 111 of seal 122. For example, as an alternative embodiment of a seal 122', shown in FIG. 1A, blade engaging extensions 122*i* and 122*j* are connected together in a large extension 122*k* which also covers and eliminates downwardly sloping flat upper blade supporting surfaces 122*b* and 122*c* of FIG. 1. In other words, there are no downwardly sloping flat upper blade supporting surfaces 122*b* and 122*c* on which the blade rests. Large extension 122*k* also extends the surface area of inner facing side wall surface 111. In this regard, a conventional blade, which is held separately by a blade holder, is positioned so that the end edges thereof (edge 131 in FIGS. 10 and 11) seal against inner facing side wall surface 111. The alignment of the end edges of the blade against inner facing side wall surface 111 can be performed manually or with detection equipment, such as an optical detector of the like.

Figure 1:
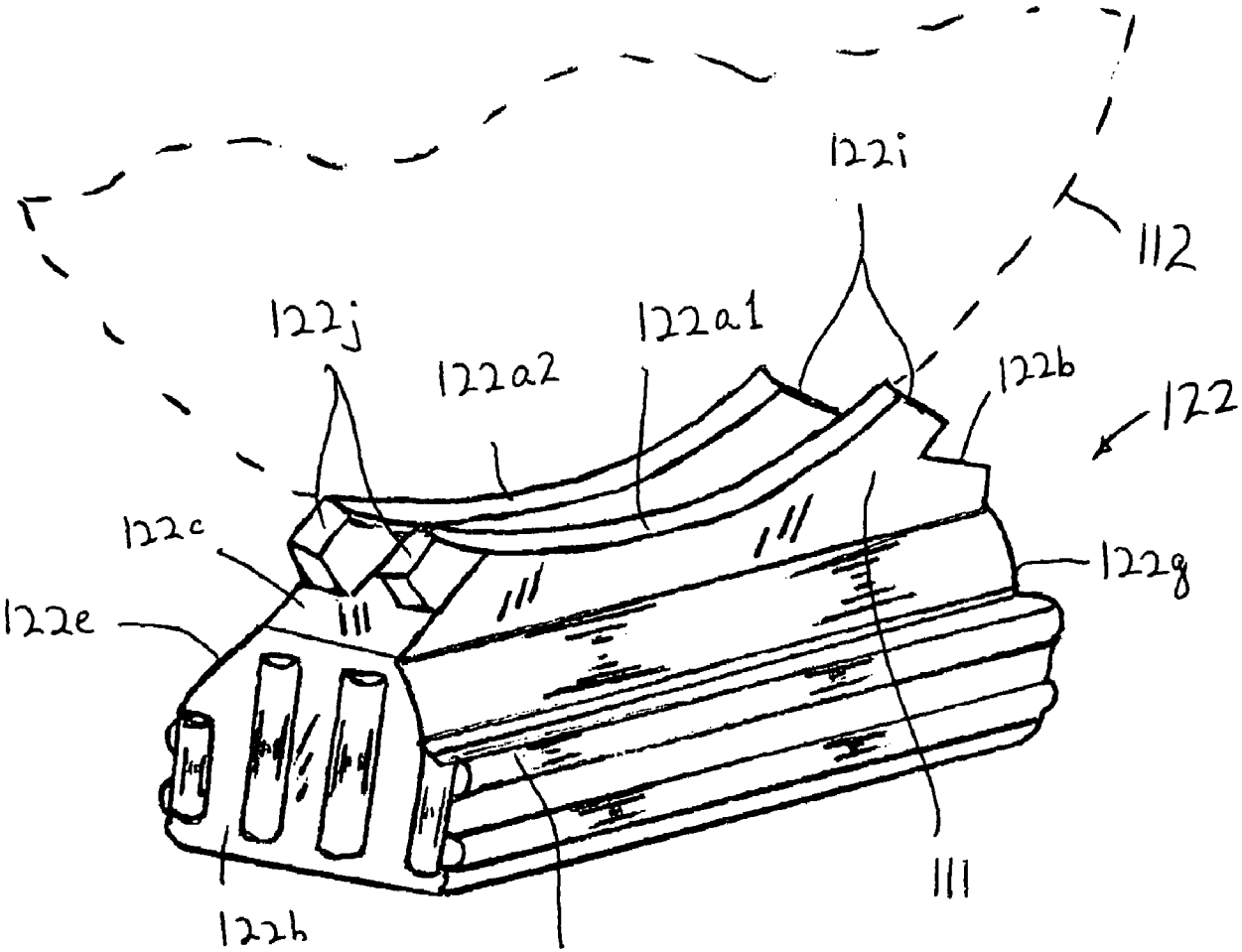
FIG. 1 is a perspective view of doctor and sealing blade seal according to the present invention.
Figure 1A:
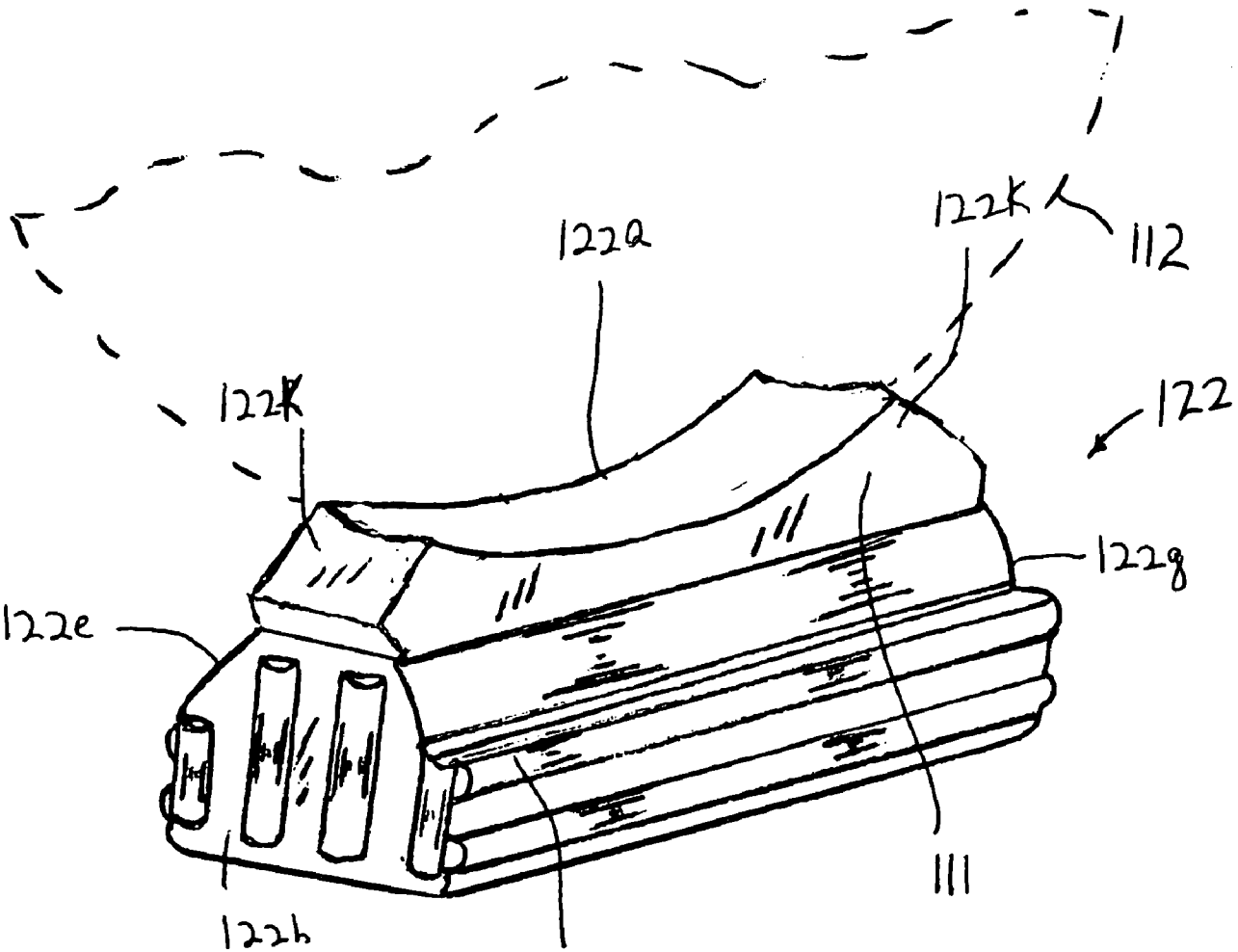
FIG. 1A is a perspective view of doctor and sealing blade seal according to another embodiment of the present invention.
Figure 2:
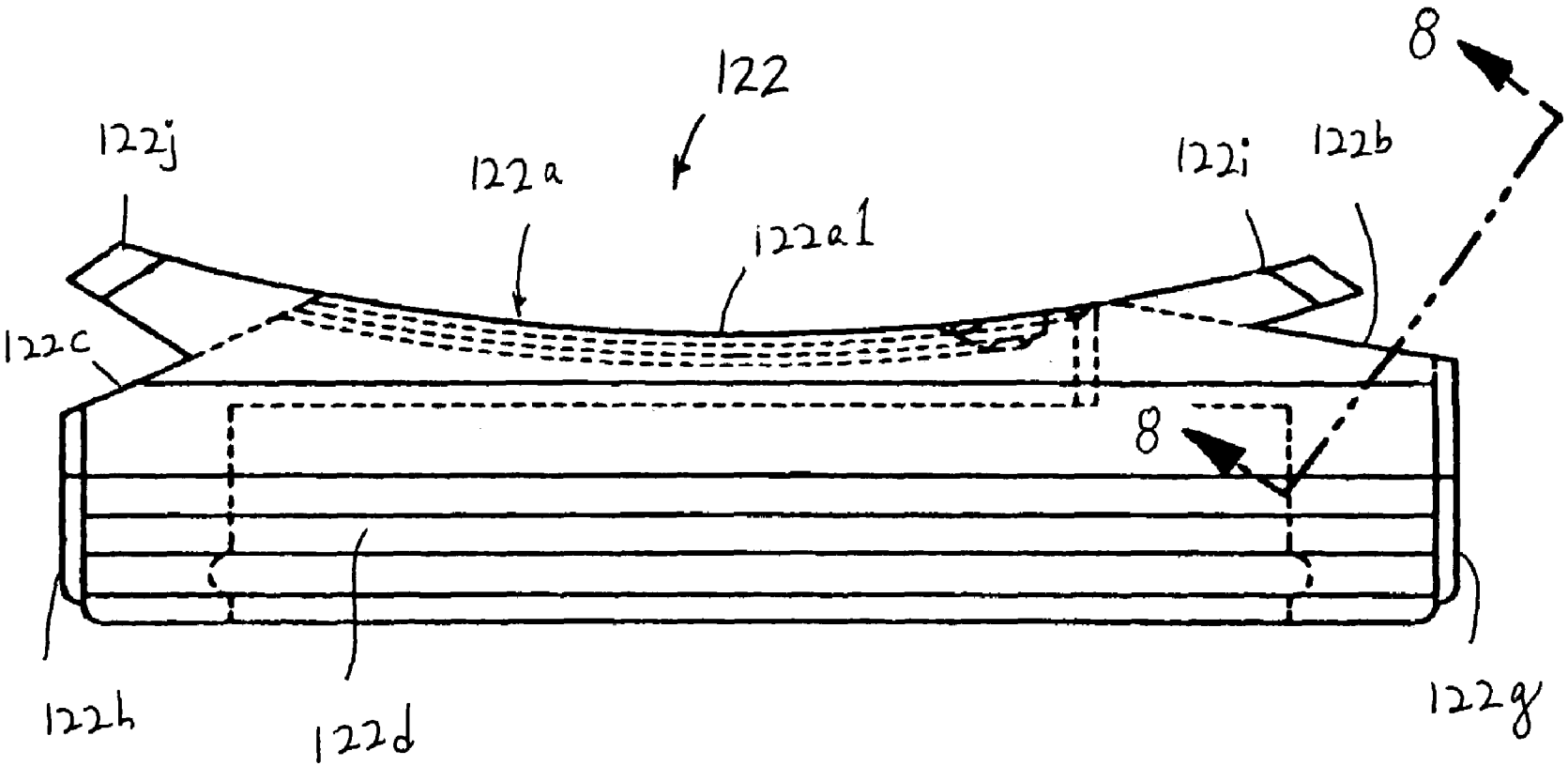
FIG. 2 is a side elevational view the doctor and sealing blade seal of FIG. 1.
Figure 3:
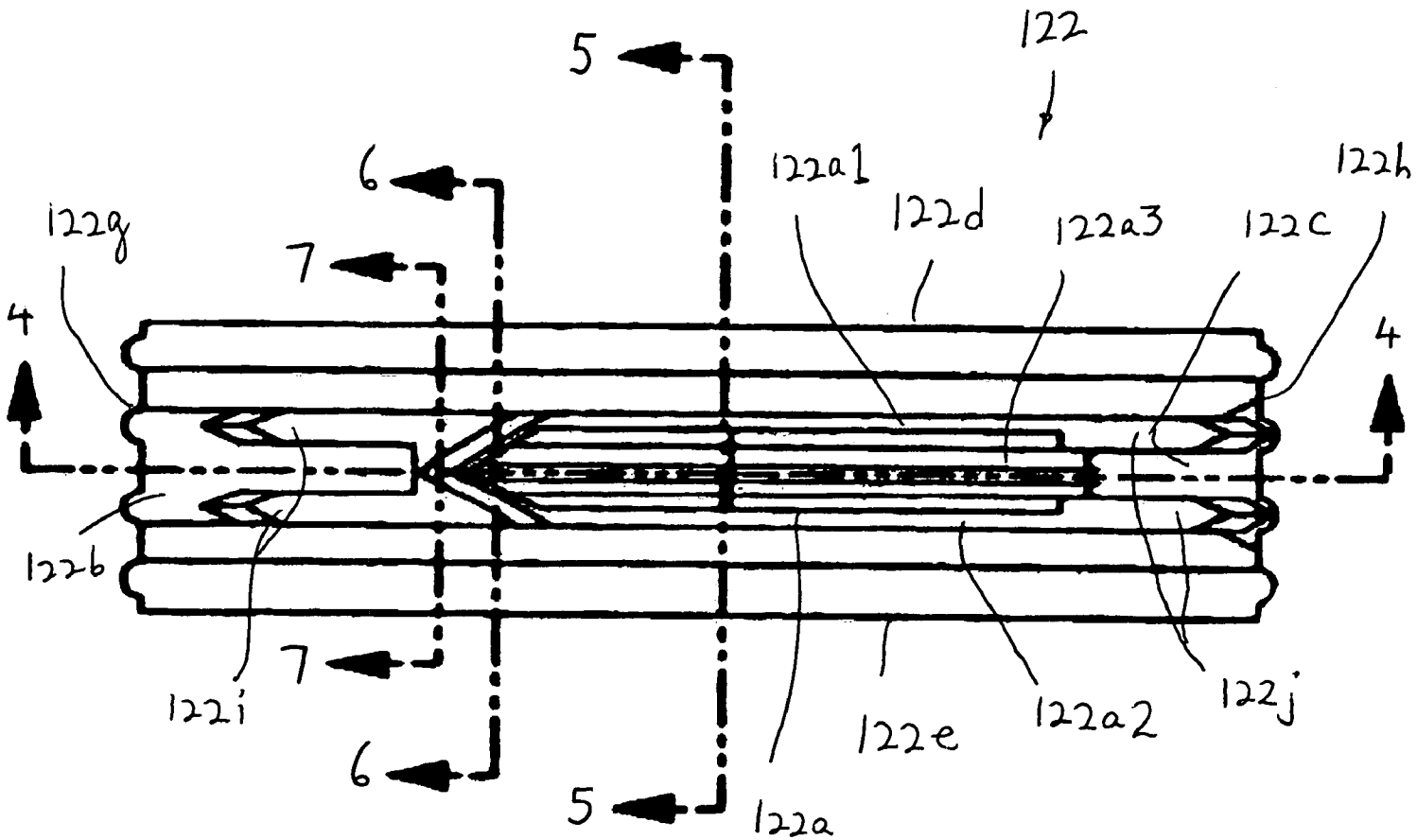
FIG. 3 is a top plan view of the doctor and sealing blade seal of FIG. 1.

It will be appreciated that the first embodiment of seal 122 of FIG. 1 has the advantage over the seal 122' of FIG. 1A of also automatically accurately aligning side edges 130*a* of blades 118 and 120 in sealing contact with inner facing side wall surface 111, as a result of notches 123 and 124 and blade engaging extensions 122*i* and 112*j*.

Figure 4:
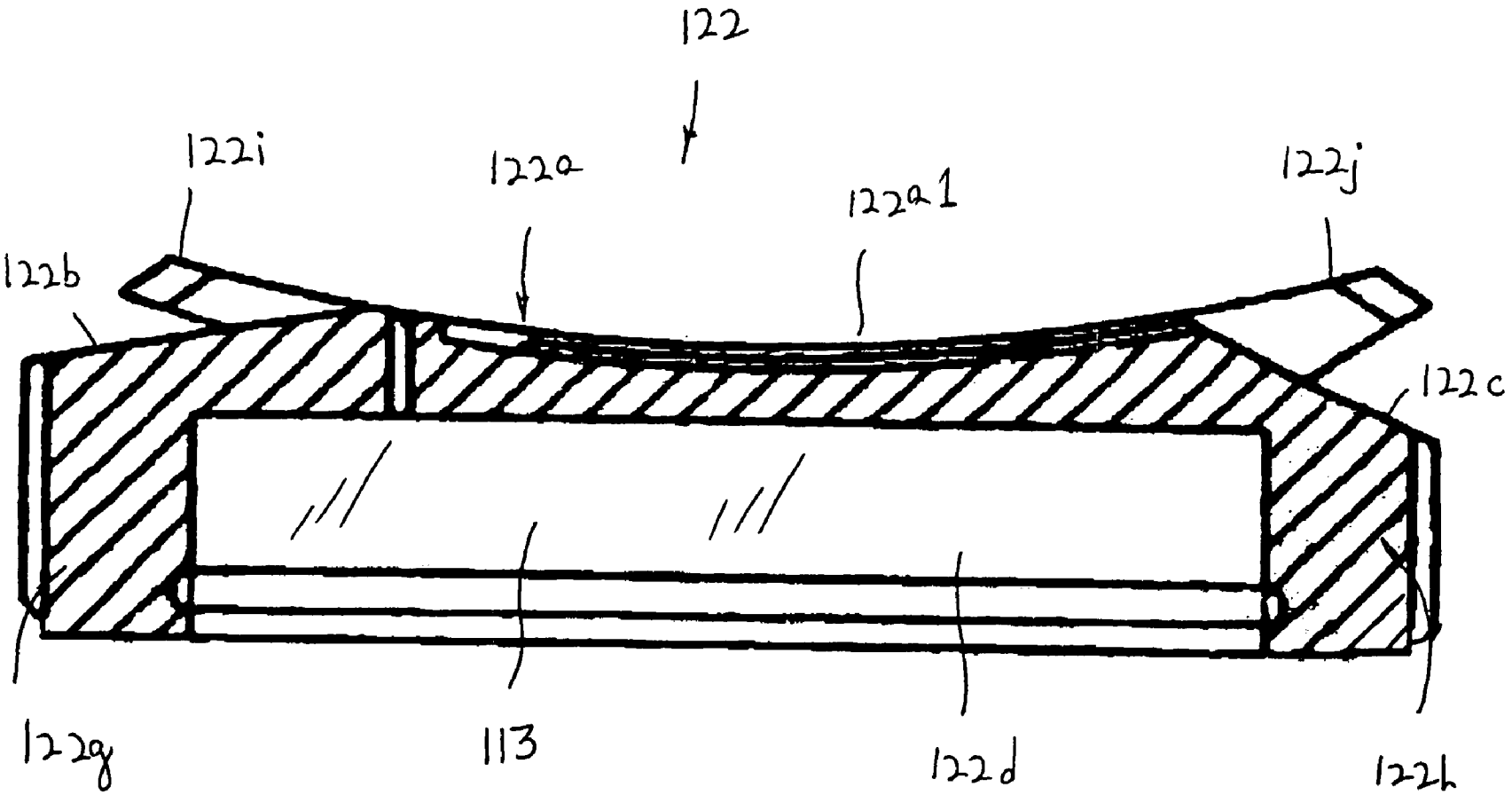
FIG. 4 is a cross-sectional view of the doctor and sealing blade seal of FIG. 3, taken along line 4-4 thereof.
Figure 5:
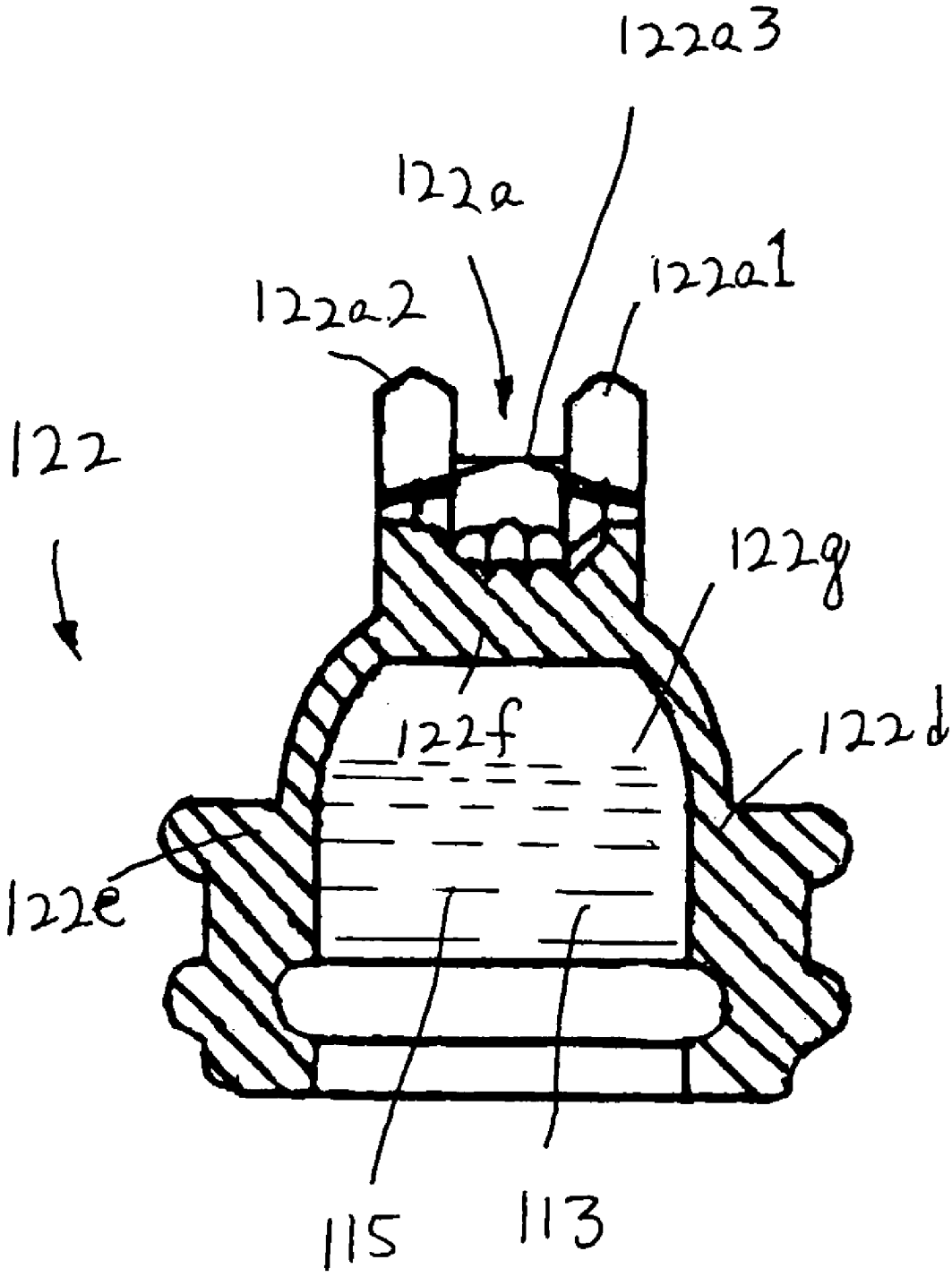
FIG. 5 is a cross-sectional view of the doctor and sealing blade seal of FIG. 3, taken along line 5-5 thereof.
Figure 6:
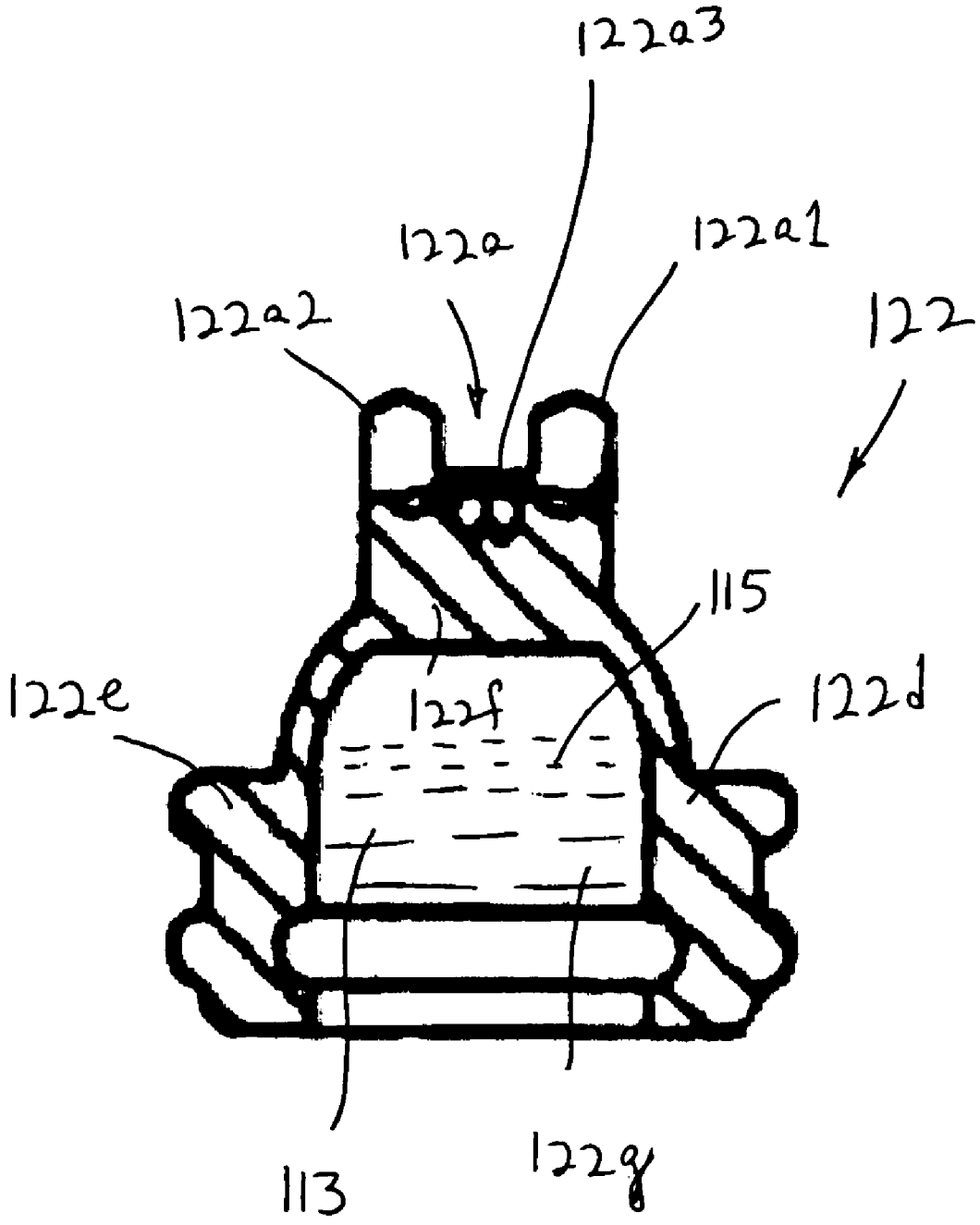
FIG. 6 is a cross-sectional view of the doctor and sealing blade seal of FIG. 3, taken along line 6-6 thereof.
Figure 7:
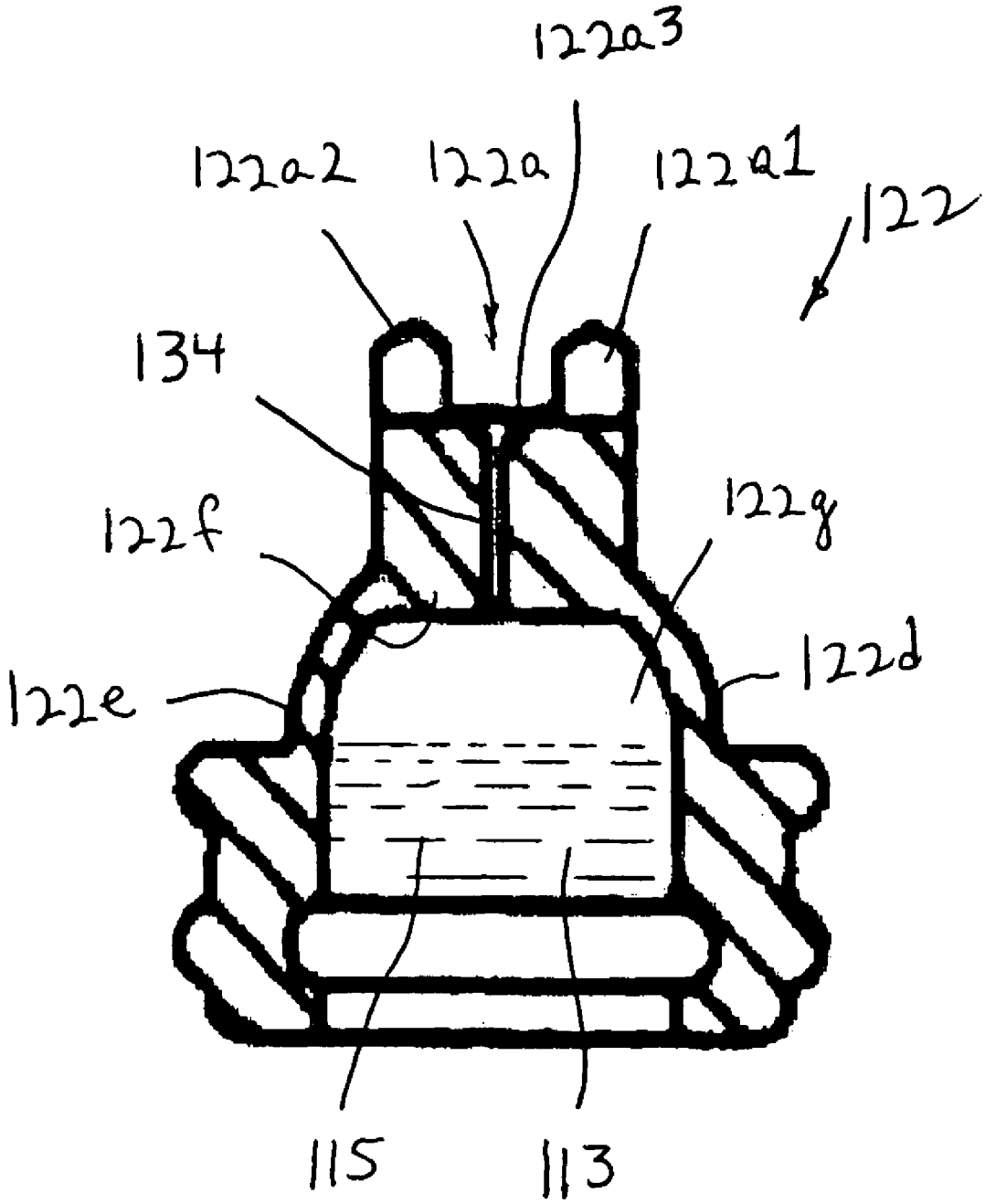
FIG. 7 is a cross-sectional view of the doctor and sealing blade seal of FIG. 3, taken along line 7-7 thereof.
Figure 8:
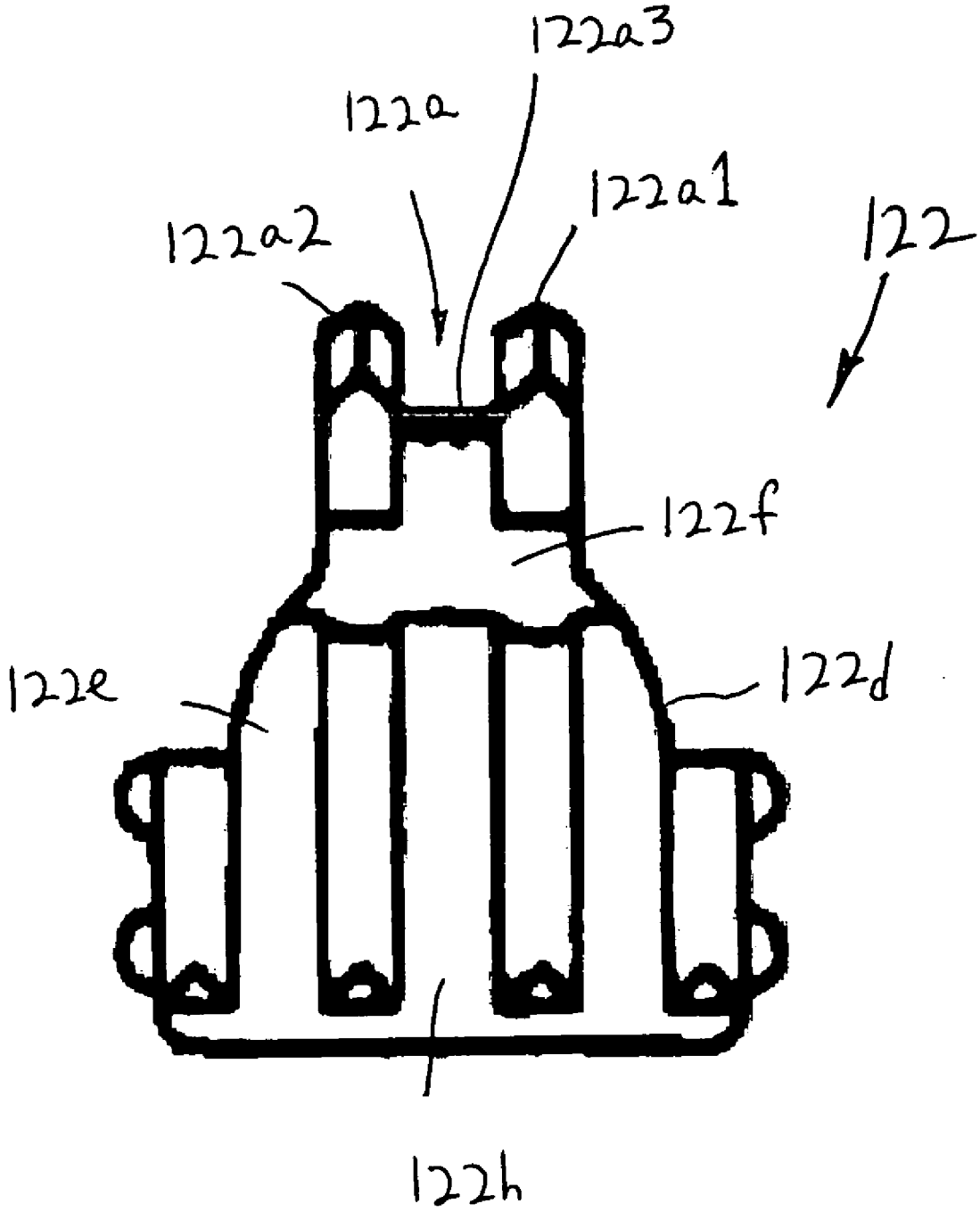
FIG. 8 is an end elevational view of the doctor and sealing blade seal of FIG. 1.

In accordance with a second aspect of the present invention, as shown best in FIGS. 4 and 7, and as discussed above, seal 122 is made from an elastomer which is deformable and resilient. The elastomer forming seal 122 has an internal lubricant chamber 113 filled with a lubricant 115. When, due to wear, the pressure on a portion of seal 122 which lies against the peripheral surface of anilox roll 112 increases, an opening 134, or a plurality of such openings, in that intermediate upper wall portion 122*a*3 of upper surface 122*a* between upper concave surface portions 122*a*1 and 122*a*2 at the inlet end, allows lubricant 115 to flow from internal lubricant chamber 113 to the interface between seal 122 and anilox roll 112. Increased pressure on seal 122 against the peripheral surface of anilox roll 112 increases the pressure of the lubricant in lubricant chamber 113 and causes the lubricant to flow from lubricant chamber 113 to the interface between seal 122 and anilox roll 112.

As a result, lubricant 115 in internal lubricant chamber 113 of seal 122 is caused to flow to the anilox roll/seal interface upon increased pressure of seal 122 on anilox roll 112, which reduces the wear on seal 122, and particularly, on upper concave surface portions 122*a*1 and 122*a*2.

It will be appreciated that, although the present invention has been discussed in relation to an anilox roll, the present invention is not limited thereby, and is applicable to any fluid carrying roll, such as a gravure roll, an ink roll, etc. Further, the present invention is not limited to rolls associated with a printing operation and can be used with other fluid carrying rolls-associated with other operations where a doctoring/sealing operation is required, such as glue rolls, etc.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A seal adapted to seal an end of a fluid chamber which supplies fluid to a roll, comprising:

at least one supporting side wall, an upper wall on said at least one supporting side wall, said upper wall including an upper concave surface adapted to engage an outer surface of the roll, said upper wall including at least one opening, opposite end walls connected to ends of said at least one supporting side wall, a lubricant chamber defined between and surrounded by said at least one supporting side wall, said upper wall and said end walls, for holding a lubricant therein, with said upper wall in covering relation to said lubricant chamber, said lubricant chamber being in fluid communication with said opening, said seal being made of a deformable and resilient material, and said seal having a configuration that provides that the seal deforms as a result of external force on said seal when in contact with the roll to increase pressure in the lubricant chamber and cause said lubricant to be forced out of said lubricant chamber through said at least one opening to an interface between said seal and the roll.

2. A seal according to claim 1, wherein each end wall includes a flat upper blade supporting surface for receiving an end of a blade thereon.

3. A seal according to claim 1, wherein said upper concave surface includes first and second spaced apart upper concave surface portions with an intermediate upper wall portion therebetween.

4. A seal according to claim 3, wherein said at least one opening is formed through said intermediate upper wall portion.

5. A seal according to claim 1, wherein said chamber extends substantially the entire height of said at least one supporting side wall.

6. A seal according to claim 1, wherein an upper end of said at least one supporting side wall includes a curved portion that connects to said upper wall, and said curved portion forms part of said configuration that provides that the seal deforms as a result of external force on said seal when in contact with the roll to increase pressure in the lubricant chamber and cause said lubricant to be forced out of said lubricant chamber through said at least one opening to the interface between said seal and the roll.

* * * * *